US009440105B1

(12) United States Patent
Lee et al.

(10) Patent No.: US 9,440,105 B1
(45) Date of Patent: Sep. 13, 2016

(54) EXERCISE APPARATUS HAVING GUIDED FOOT PAD CARRIERS AND A WEIGHT STACK

(71) Applicant: TCDP, LLC, Huntington Beach, CA (US)

(72) Inventors: Scott Lee, Pomfret Center, CT (US); Thomas Gilbert Jones, Huntington Beach, CA (US)

(73) Assignee: TCDP, LLC, Huntington Beach, CA (US)

( * ) Notice: Subject to any disclaimer, the term of this patent is extended or adjusted under 35 U.S.C. 154(b) by 0 days.

(21) Appl. No.: 14/754,518

(22) Filed: Jun. 29, 2015

Related U.S. Application Data

(63) Continuation-in-part of application No. 14/304,886, filed on Jun. 14, 2014.

(51) Int. Cl.
*A63B 21/00* (2006.01)
*A63B 23/04* (2006.01)

(52) U.S. Cl.
CPC ..... *A63B 21/1488* (2013.01); *A63B 21/1465* (2013.01); *A63B 23/04* (2013.01)

(58) Field of Classification Search
CPC ..... A63B 21/00
USPC ..... 482/51, 52, 70, 71, 93, 99, 101
See application file for complete search history.

(56) References Cited

U.S. PATENT DOCUMENTS 4,653,749 A * 3/1987 Rorabaugh ..... A63B 69/182 482/114
5,833,584 A * 11/1998 Piaget ..... A63B 22/0012 482/51
6,302,830 B1 * 10/2001 Stearns ..... A63B 22/205 482/51
2012/0053019 A1 * 3/2012 Reyes ..... A63B 21/00069 482/52

* cited by examiner

*Primary Examiner* — Jerome w Donnelly
(74) *Attorney, Agent, or Firm* — Barcelo, Harrison & Walker, LLP

(57) ABSTRACT

An apparatus for human exercise in certain configurations includes a first foot pad attached to a first guided carrier member. A first curved guide rail is coupled to the first guided carrier member. The first curved guide rail prevents motion of the first guided carrier member except for translation along the first curved guide rail. A weight stack includes a first plurality of weights coupled to a first cable. The first cable is also coupled to the first foot pad. A tension in the first cable may oppose a translation of the first foot pad along the first curved guide rail. A stationary foot platform is fixed to the apparatus between the first curved guide rail and the weight stack. The first curved guide rail is curved away from an underlying ground plane, to define a rail height that decreases towards the stationary foot platform.

17 Claims, 8 Drawing Sheets

EXERCISE APPARATUS HAVING GUIDED FOOT PAD CARRIERS AND A WEIGHT STACK

This application claims priority under 35 U.S.C. §120 as a continuation-in part to pending U.S. patent application Ser. No. 14/304,886 filed on 2014 Jun. 14, entitled "Exercise Apparatus Having Guided Foot Pad Carriers," which is hereby incorporated by reference.

BACKGROUND

There are hundreds of different muscles in the human body, and a plethora of other connective tissues and anatomical structures for which exercise and stretching may improve strength and/or mobility. Different stretches or exercises may benefit different subsets of these muscles and connective tissues, with tens of thousands of combinations being possible. Moreover, human fitness can be defined or measured in various ways, many of which are personal and subjective to the exercise apparatus user. Hence, subtle differences in an exercise apparatus may unpredictably change the commercial or practical success of the apparatus.

Many contemporary exercise machines focus on muscle groups that are already well developed in the average user. Other contemporary exercise machines may focus on often under-developed muscle groups, but may invite injury by presenting too much or too little resistance to motion, and/or too easily allow over-stretching of muscles or connective tissue. Other contemporary exercise machines may avoid one or more of the foregoing pitfalls, but at a cost or with complexity that inhibits market acceptance.

Hence there is an ongoing substantial need in the art for improved exercise apparatus designs that can safely improve strength and/or flexibility of connective tissue and muscle combinations that are often under-developed in the average human, with adequate service life and reliability, and that can be practically manufactured at a cost that allows marketability at a profit.

DESCRIPTION OF THE PREFERRED EMBODIMENTS

Figure 1A:
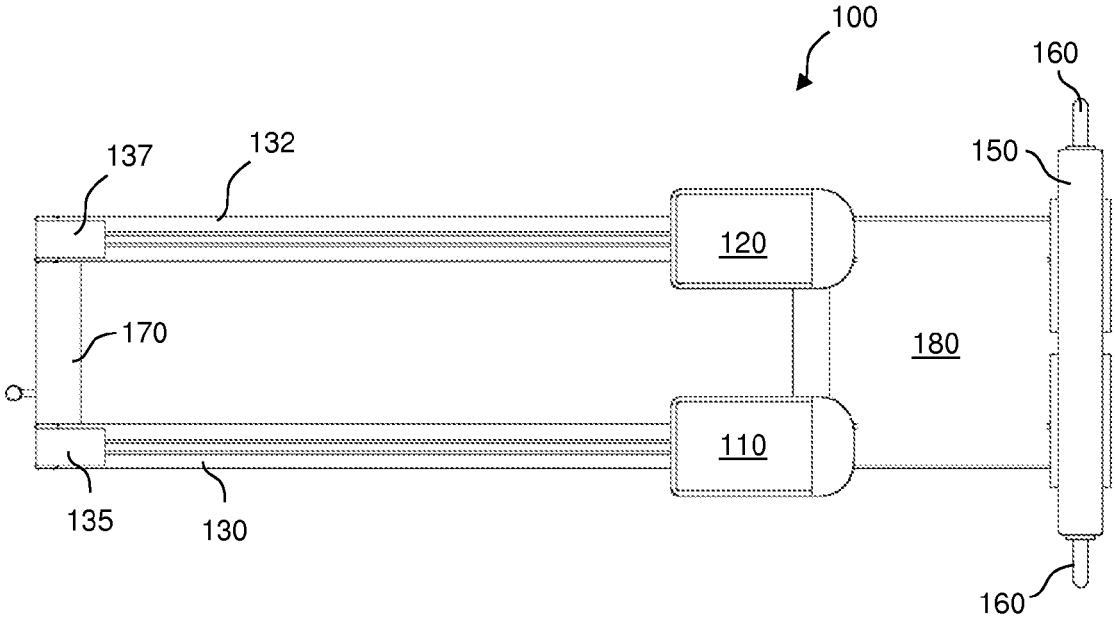
FIG. 1A is a top view of an apparatus for human exercise according to an example embodiment of the present invention.
Figure 1B:
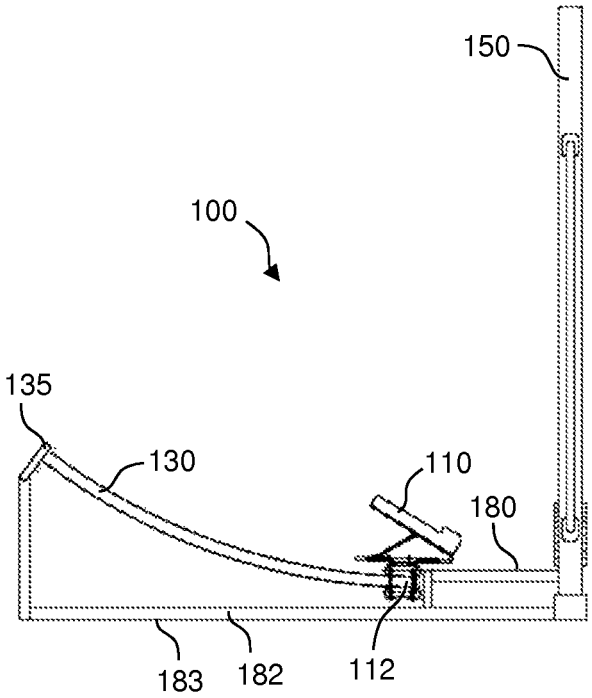
FIG. 1B is a side view of the apparatus of FIG. 1A.
Figure 1C:
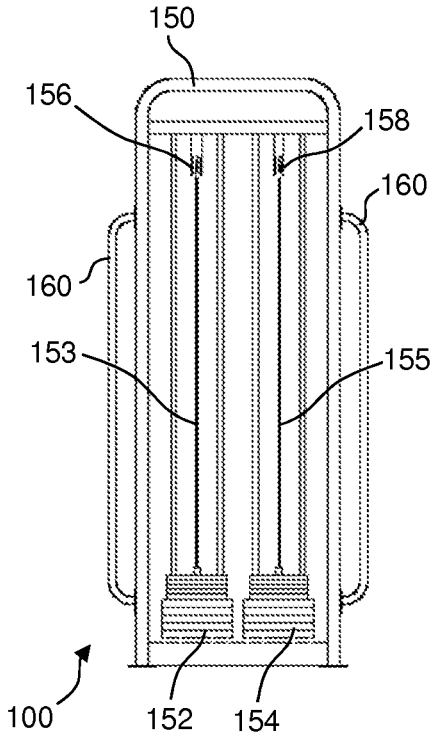
FIG. 1C is an end view of the apparatus of FIGS. 1A and 1B.
Figure 1D:
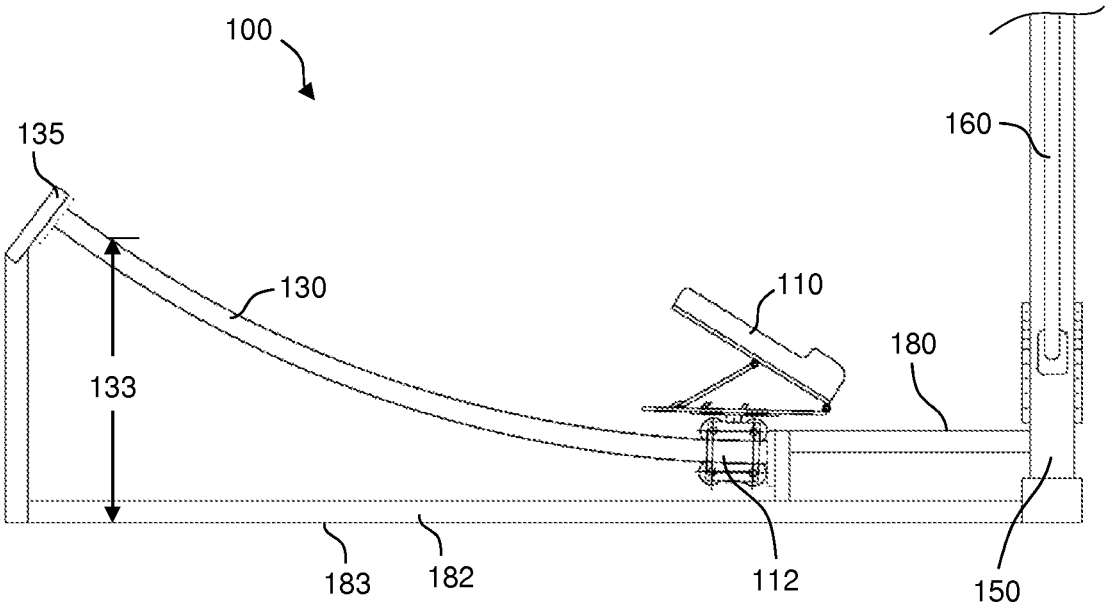
FIG. 1D is an expanded portion of FIG. 1B.

FIG. 1A is a top view of an apparatus 100 for human exercise according to an example embodiment of the present invention, which may safely improve strength and/or flexibility of connective tissue and muscle combinations that are often under-developed in the average human user. FIG. 1B is a side view of the apparatus 100, FIG. 1C is an end view of the apparatus 100, and FIG. 1D is an expanded portion of FIG. 1B. The embodiment of FIGS. 1A-D include a first foot pad 110 and a second foot pad 120. As shown in FIGS. 1B and 1D, the foot pad 110 is attached to a first guided carrier member 112. Likewise, the second foot pad 120 is attached to a similar second guided carrier member. In this context, the first and second foot pads 110, 120 need not be soft or include a cushion to be referred to herein as a pad; rather, the first and second foot pads 110, 120 may be hard foot pedals.

In the embodiment of FIGS. 1A-D, the apparatus 100 includes first and second curved guide rails 130 and 132. The first curved guide rail 130 is coupled to the first guided carrier member 112. Likewise, the second curved guide rail 132 is coupled to the second guided carrier member to which the second foot pad 120 is attached. Functionally, the curved guide rails 130 and 132 may substantially prevent translation of the first and second foot pads 110 and 120 except for translation along the curved guide rails 130, 132, respectively.

Each of the first curved guide rail 130 and the second curved guide rail 132 is preferably curved away from an underlying ground plane 183, so that a guide rail height 133 increases distally (towards the left in FIG. 1D), as does the guide rail slope. Therefore, as shown in FIG. 1D, the guide rail height 133 is greater at the distal end of the curved guide rail 130 (left side in FIG. 1D) than at the proximal end (right side in FIG. 1D), with a concavity facing upwards. The second guide rail 132 is similarly curved. In certain applications of the apparatus 100, such curvature of the guide rails 130, 132 may advantageously improve body kinematics during certain leg extension exercises.

In certain embodiments, an impact dampening layer or other conventional shock absorbing mechanism may be placed at either or both ends of the curved guide rails 130, 132, to reduce the severity of impacts at the limits of foot pad travel. For example, as shown in FIGS. 1B and 1D, the curved guide rail 130 may optionally include an impact dampening end plate 135 (e.g. having a viscoelastic damping layer disposed thereupon) at one of the limits of travel of the first guided carrier member 112. Likewise, as shown in FIG. 1A, the curved guide rail 132 may include a similar impact dampening end plate 137.

The apparatus 100 may include a stationary platform 180 that does not translate and that is fixed to a horizontal base member 182 adjacent to the first and second curved guide rails 130, 132. Optionally the horizontal base member 182 may include a downward facing conventional polymer traction grip for increasing friction with an underlying floor or ground surface upon which the apparatus 100 rests. In certain embodiments, the optional addition of the stationary platform 180 may allow additional exercises to be performed, such as abdominal exercises that may be facilitated by a user placing hands on the stationary platform 180 and feet on the foot pads 110 and 120.

The embodiment of FIGS. 1A-D may also include a cable and pulley operated weight stack 150 for resisting motion of the foot pedals 110 and 120 along the guide rails 130, 132, respectively, for example to increase muscle fatigue during exercise. As shown in FIG. 1C, the weight stack 150 may include first and second pluralities of weights 152, 154, which may provide a tension force to cables 153, 155, respectively. The tension force may be user-selectable by placement of a lifting pin into one of the pluralities of weights, at a desired height. The cable tension may be communicated to act upon the foot pads 110 and 120 by conventional cable routing by pulleys (e.g. pulleys 156, 158). Aspects of the structure, assembly, cable routing, and operation of the weight stack 150 that are not described herein, are conventional.

In the embodiment of FIGS. 1A-D, the exercise apparatus 100 optionally includes side handles 160 fixed to the sides of the weight stack assembly 150. In certain applications, the user of the apparatus 100 may grasp one or both of the side handles 160 for body support while accomplishing an exercise involving the foot pads 110 and 120. In FIG. 1A, the stationary platform 180 is disposed between the weight stack 150 and the first and second curved guide rails 130, 132.

In certain embodiments, a frame of the weight stack assembly 150, or the side handles 160, may optionally include a plurality of conventional anchors (e.g. hooks, eyelets, etc) for selectively attaching elastic members, for example to facilitate the performance of various conventional upper body exercises in conjunction with other uses of the exercise apparatus 100. Such elastic members may be conventional bungee cords with handles at each end (not shown), for enabling upper body (e.g. arm) exercise—optionally simultaneously with user operation of the foot pads 110, 120.

Figure 2:
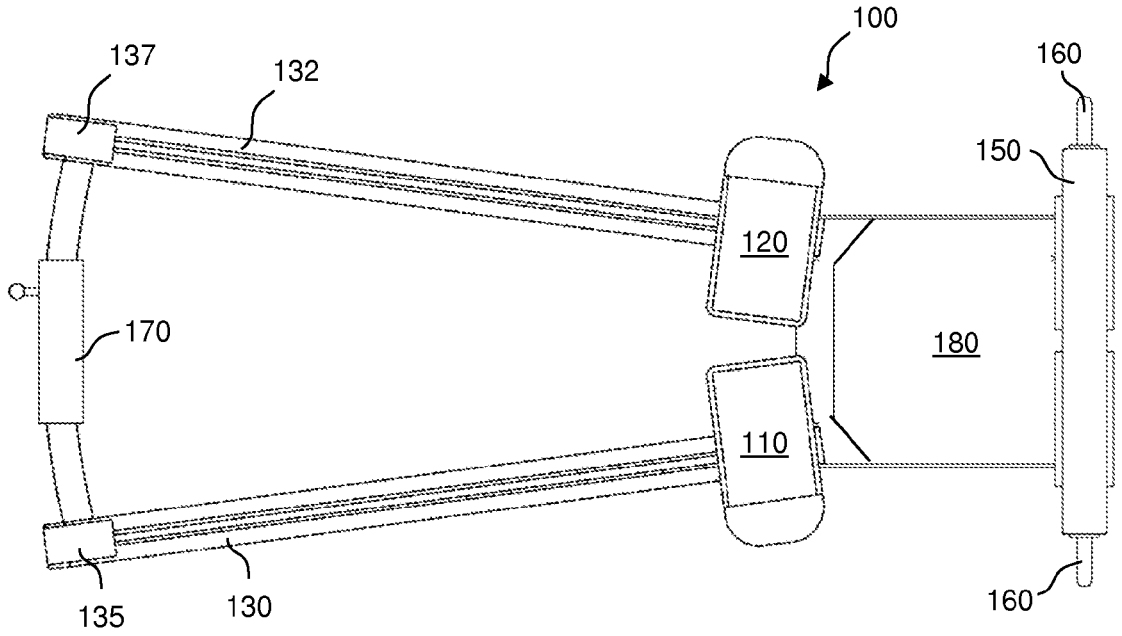
FIG. 2 is a top view of the apparatus of FIG. 1A, in another configuration.

In the embodiment of FIG. 1A, the apparatus 100 may include a transverse spacer 170 that may be oriented horizontally and transverse to the curved guide rails 130, 132. FIG. 2 is a top view of the apparatus 100, in an alternative configuration. As shown in the example of FIG. 2, the first transverse spacer 170 optionally may be of telescopic construction, to allow adjustable extension to increase the spacing between the distal ends of the curved guide rails 130, 132. In certain embodiments, the angular divergence of the guide rails 130, 132 caused by extending the transverse spacer 170 may provide improved body kinematics during certain exercises that employ the foot pedals 110 and 120. For conciseness, the description of features in FIG. 2 that are labeled with the same number as corresponding features that were described with reference to FIGS. 1A-D may not be repeated.

In certain embodiments, each of the first and second foot pads 110, 120 optionally may be pivotably attached to a corresponding guided carrier member by a conventional pivot attachment. Such pivot attachment optionally may include a conventional torsional elastic member (e.g. torsional spring) that applies a restoring torque to the foot pad. In this context, applying a restoring torque means that if/when the user pivots the foot pad 110 or 120 from a rest angular position, the conventional torsional elastic member torques that foot pad in an opposite sense to tend to return that foot pad to the rest angular position. This may provide an advantageous exercise or stretching resistance to the user of the apparatus 100.

Note that in FIG. 2, the foot pads 110 and 120 are optionally pivoted to an orientation that is transverse to the corresponding guide rail 130, 132. By contrast, FIG. 1A depicts the foot pads 110 and 120 being optionally pivoted to an orientation that is parallel to the corresponding guide rail 130, 132. In certain applications, such optional ability of the foot pads to pivot may facilitate certain exercises or a greater variety of exercises. For example, the transverse orientation of FIG. 2 may facilitate exercise of the user's body in a sideways axis, with the primary movement being in the frontal plane, and while introducing various degrees of flexion and extension. By contrast, the parallel orientation of FIG. 1A may facilitate exercise of the user's body in a forward and backward axis, with the primary movement being in the sagittal plane, and while introducing various degrees of abduction.

Figure 3A:
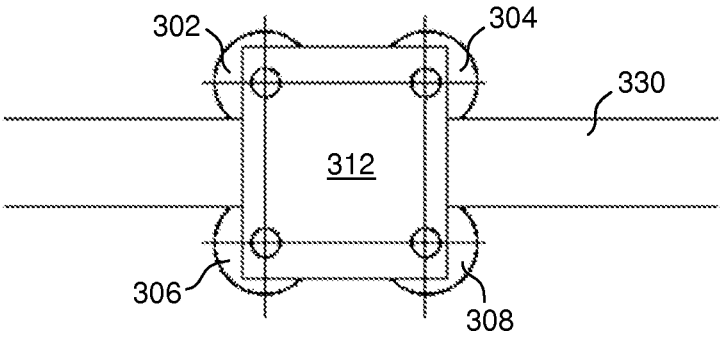
FIG. 3A is a side view of an example rolling guided carrier member for guiding a foot pad along a guide rail, according to certain embodiments of the present invention.
Figure 3B:
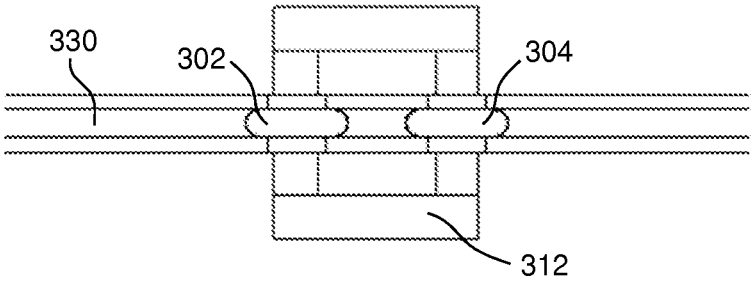
FIG. 3B is a top view of the example rolling guided carrier member of FIG. 3A.

FIG. 3A is a side view of an example guided carrier member 312 for guiding a foot pad along a guide rail 330, according to certain embodiments of the present invention. FIG. 3B is a top view of the example guided carrier member 312. In the embodiment of FIGS. 3A-B, the guided carrier member 312 may include four rollers 302, 304, 306, 308 that may contact the guide rail 330 to substantially prevent motion of the guided carrier member 312 except for translation along the guide rail 330.

Figure 4A:
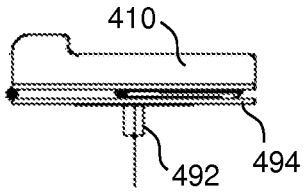
FIG. 4A is a side view of a tilting foot pad assembly for use with certain embodiments of the present invention, in a non-tilted 0° position.
Figure 4B:
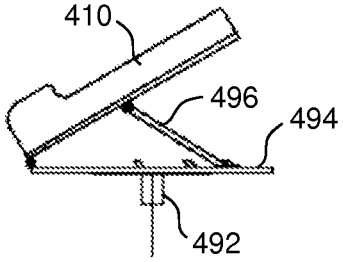
FIG. 4B is a side view of the tilting foot pad assembly of FIG. 4A, in a 30° tilted position.
Figure 4C:
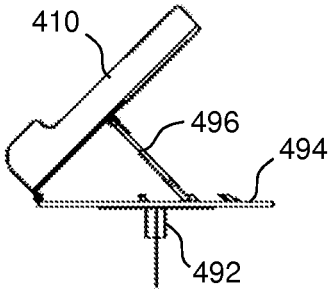
FIG. 4C is a side view of the tilting foot pad assembly of FIG. 4A, in a 45° tilted position.
Figure 4D:
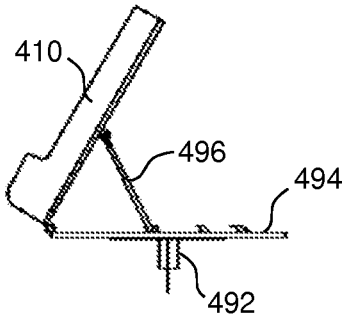
FIG. 4D is a side view of the tilting foot pad assembly of FIG. 4A, in a 60° tilted position.

Note that the foot pad 110 is shown in a tilted configuration in FIGS. 1B and 1D. An example mechanism for the tilting of foot pads may be described with reference to FIGS. 4A-4D. FIG. 4A is a side view of a tilting foot pad assembly 410 for use with certain embodiments of the present invention, in a non-tilted 0° position. FIG. 4B is a side view of the tilting foot pad assembly 410 in a 30° tilted position. FIG. 4C is a side view of the tilting foot pad assembly 410 in a 45° tilted position. FIG. 4D is a side view of the tilting foot pad assembly 410 in a 60° tilted position. In certain applications, the foregoing tilted positions may advantageously help the exercising user to achieve a neutral or various non-neutral plantar flexion positions.

In each of the tilted positions shown in FIGS. 4B-D, the desired tilting is optionally accomplished by engagement of a hinged plate 496 with a selected one of a plurality of plate stops in or on a foot pad base 494. In the non-tilted position shown in FIG. 4A, the hinged plate is collapsed without engagement with any of the plate stops of the foot pad base 494. Note that the foot pad assembly 410 optionally may include a downwardly protruding pivot post 492 for rotatable engagement with a receiving bore in an underlying guided carrier member.

Figure 5A:
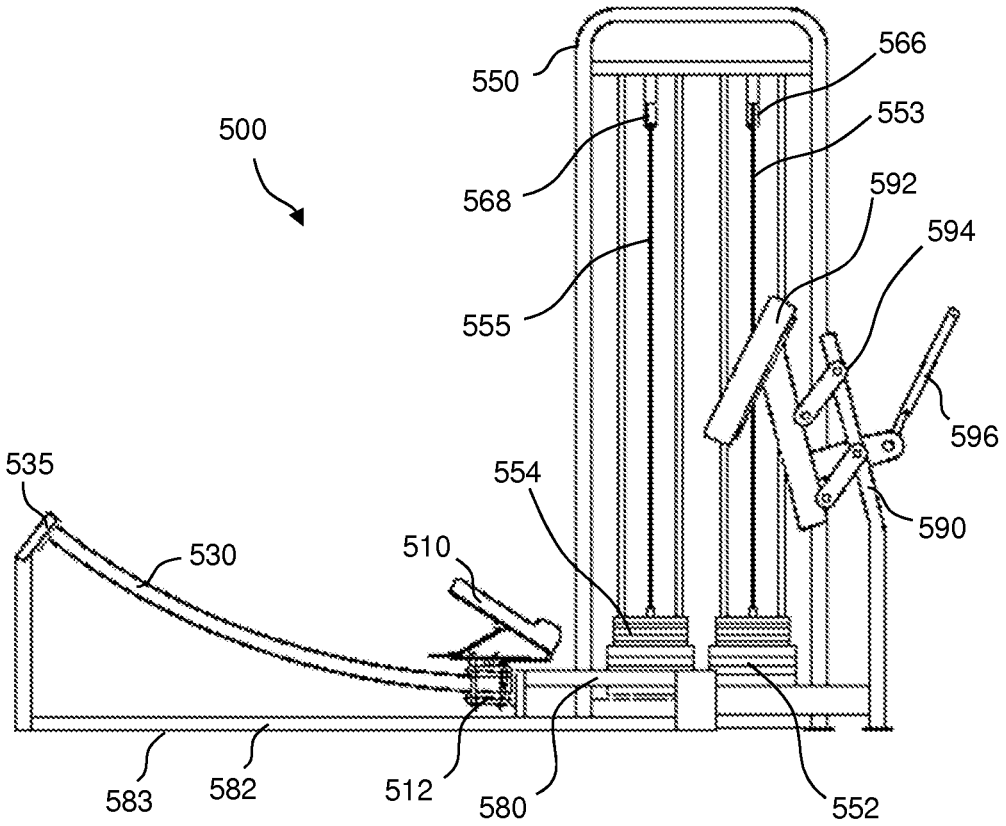
FIG. 5A is a side view of an apparatus for human exercise according to another example embodiment of the present invention.
Figure 5B:
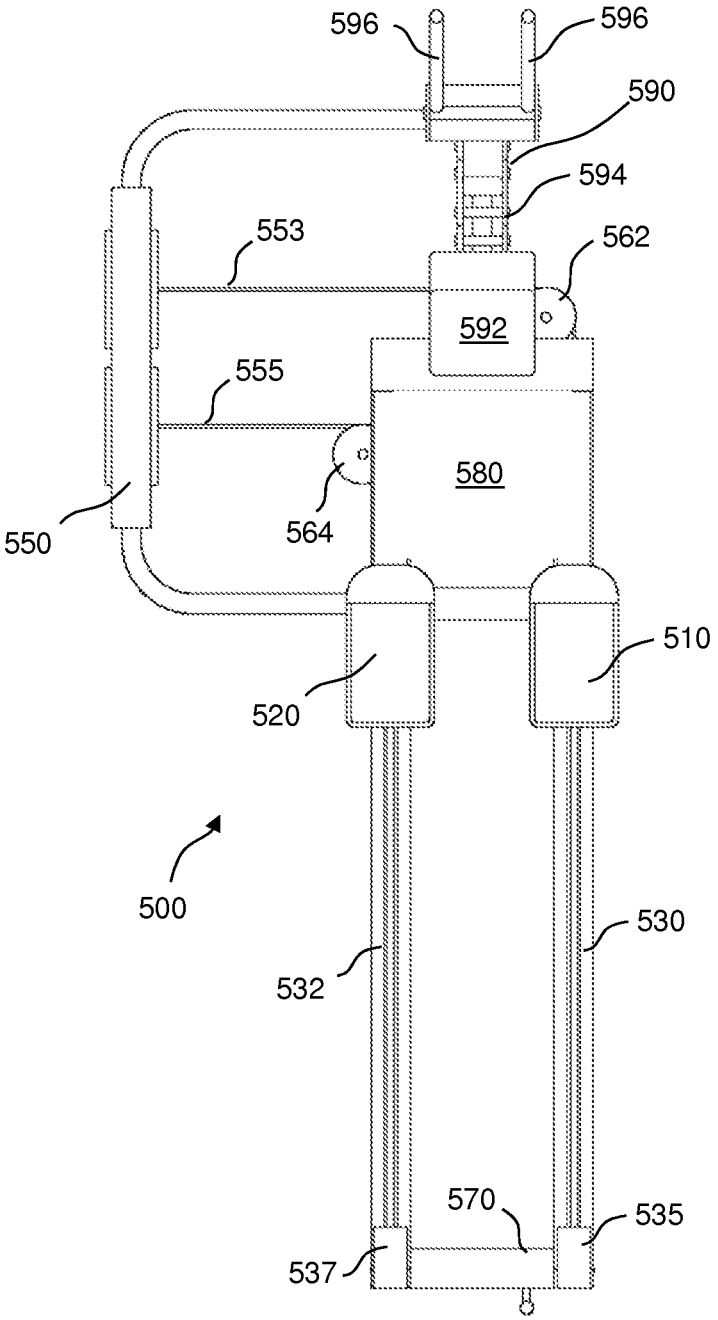
FIG. 5B is a top view of the apparatus of FIG. 5A.

FIG. 5A is a side view of an apparatus 500 for human exercise according to another example embodiment of the present invention, which may safely improve strength and/or flexibility of connective tissue and muscle combinations that are often under-developed in the average human user. FIG. 5B is a top view of the apparatus 500. The embodiment of FIGS. 5A-B include a first foot pad 510 and a second foot pad 520. As shown in FIG. 5A, the foot pad 510 is attached to a first guided carrier member 512. Likewise, the second foot pad 520 is attached to a similar second guided carrier member. In this context, the first and second foot pads 510, 520 need not be soft or include a cushion to be referred to herein as a pad; rather, the first and second foot pads 510, 520 may be hard foot pedals.

In the embodiment of FIGS. 5A-B, the apparatus 500 includes first and second curved guide rails 530 and 532. The first curved guide rail 530 is coupled to the first guided carrier member 512. Likewise, the second curved guide rail 532 is coupled to the second guided carrier member to which the second foot pad 520 is attached. Functionally, the curved guide rails 530 and 532 substantially prevent translation of the first and second foot pads 510 and 520 except for translation along the curved guide rails 530, 532, respectively.

Each of the first curved guide rail 530 and the second curved guide rail 532 is preferably curved away from an underlying ground plane 583. In certain applications of the apparatus 500, such curvature of the guide rails 530, 532 may advantageously improve body kinematics during certain leg extension exercises.

In certain embodiments, an impact dampening layer or other conventional shock absorbing mechanism may be placed at either or both ends of the curved guide rails 530, 532, to reduce the severity of impacts at the limits of foot pad travel. For example, as shown in FIG. 5A, the curved guide rail 530 may optionally include an impact dampening end plate 535 (e.g. having a viscoelastic damping layer disposed thereupon) at one of the limits of travel of the first guided carrier member 512. Likewise, as shown in FIG. 5B, the curved guide rail 532 may include a similar impact dampening end plate 537.

The apparatus 500 may include a stationary platform 580 that does not translate and that is fixed to a horizontal base member 582 adjacent to the first and second curved guide rails 530, 532. Optionally the horizontal base member 582 may include a downward facing conventional polymer traction grip for increasing friction with an underlying floor or ground surface upon which the apparatus 500 rests. In certain embodiments, the optional addition of the stationary platform 580 may allow additional exercises to be performed, such as abdominal exercises that may be facilitated by a user placing hands on the stationary platform 580 and feet on the foot pads 510 and 520.

The embodiment of FIGS. 5A-B may also include a cable and pulley operated weight stack 550 for resisting motion of the foot pedals 510 and 520 along the guide rails 530, 532, respectively, for example to increase muscle fatigue during exercise. As shown in FIG. 5A, the weight stack 550 may include first and second pluralities of weights 552, 554, which may provide a tension force to cables 553, 555, respectively. The tension force may be user-selectable by placement of a lifting pin into one of the pluralities of weights, at a desired height. The cable tension may be communicated to act upon the foot pads 510 and 520 by conventional cable routing by pulleys (e.g. pulleys 562, 564, 566, 568). Aspects of the structure, assembly, cable routing, and operation of the weight stack 550 that are not described herein, are conventional.

In the embodiment of FIG. 5B, the apparatus 500 may include a transverse spacer 570 that may be oriented horizontally and transverse to the curved guide rails 530, 532. The first transverse spacer 570 optionally may be of telescopic construction, to allow adjustable extension to increase the spacing between the distal ends of the curved guide rails 530, 532. In certain embodiments, an angular divergence of the guide rails 530, 532 caused by extending the transverse spacer 570 may provide improved body kinematics during certain exercises that employ the foot pedals 510 and 520.

As shown in FIGS. 5A-B, the weight stack 550 is oriented parallel to the second curved guide rail 532, and is disposed adjacent a side of the second curved guide rail 532. In this context, the weight stack 550 is considered to be oriented in alignment with the longest dimension of its footprint. By contrast, in the embodiment of FIGS. 1A-D, the weight stack 150 is oriented transverse to the first curved guide rail 130, and is disposed adjacent an end of the first curved guide rail 130. The parallel orientation of the weight stack 550 in FIGS. 5A-B optionally may be facilitated by redirection of the cables 553, 555 by the pulleys 562, 564, respectively.

In the embodiment of FIGS. 5A-B, the apparatus 500 may include an upper body supporting assembly 590 disposed adjacent an end of the first curved guide rail 530. In certain embodiments, the upper body supporting assembly 590 may include a chest supporting pad 592 that may preferably be disposed in a tilted relationship to a vertical plane. In the embodiment of FIGS. 5A-B, the upper body supporting assembly 590 may include a four-bar linkage 594 that serves as a height adjustment mechanism to which the chest supporting pad 592 is coupled for height adjustment of the chest supporting pad 592. In certain embodiments, the upper body supporting assembly 590 may also include a pair of hand grips 596 to which the user may grasp for better control during exercise.

In the foregoing specification, the invention is described with reference to specific exemplary embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably," and the phrase "preferably but not necessarily," are used synonymously herein to consistently include the meaning of "not necessarily" or optionally. "Comprising," "including," and "having," are intended to be open-ended terms.

We claim:

1. An apparatus for human exercise comprising:

a first foot pad attached to a first guided carrier member;

a first curved guide rail coupled to the first guided carrier member, the first curved guide rail preventing motion of the first guided carrier member except for translation along the first curved guide rail;

a weight stack comprising a first plurality of weights coupled to a first cable, the first cable also coupled to the first foot pad, a tension in the first cable opposing a translation of the first foot pad along the first curved guide rail; and a stationary foot platform that is fixed to the apparatus between the first curved guide rail and the weight stack;

wherein the first curved guide rail is curved away from an underlying ground plane, to define a rail height that decreases towards the stationary foot platform.

2. The apparatus of claim 1 further comprising a second foot pad attached to a second guided carrier member; and a second curved guide rail coupled to the second guided carrier member, the second curved guide rail preventing motion of the second guided carrier member except for translation along the second curved guide rail;

wherein the weight stack further comprises a second plurality of weights coupled to a second cable, the second cable also coupled to the second foot pad.

3. The apparatus of claim 2 further comprising an extendable transverse spacer between a distal end of the first curved guide rail and a distal end of the second curved guide rail.

4. The apparatus of claim 1 wherein first guided carrier member includes a plurality of wheels in contact with the first curved guide rail.

5. The apparatus of claim 1 wherein the first foot pad defines a foot pad surface normal, and the first foot pad includes a hinge for tilting the foot pad surface normal relative to the underlying ground plane.

6. The apparatus of claim 1 wherein the first foot pad defines a foot pad surface normal, and the first foot pad includes a pivot for pivoting the first foot pad about the foot pad surface normal.

7. The apparatus of claim 6 wherein the first foot pad is pivotably attached to the first guided carrier member by the pivot.

8. The apparatus of claim 1 wherein the first guided carrier member includes a first locking mechanism for selectively immobilizing the first guided carrier member with respect to the first curved guide rail.

9. The apparatus of claim 1 wherein a rail height of the first curved guide rail increases distally away from the weight stack.

10. The apparatus of claim 1 wherein the apparatus includes a polymer traction grip in contact with the underlying ground plane, for increasing friction with an underlying floor upon which the apparatus rests.

11. The apparatus of claim 1 wherein the weight stack further comprising a weight stack frame, and wherein the apparatus further comprises a side handle attached to the weight stack frame.

12. The apparatus of claim 1 wherein the weight stack is oriented transverse to the first curved guide rail, and is disposed adjacent an end of the first curved guide rail.

13. The apparatus of claim 2 wherein the weight stack is oriented parallel to the second curved guide rail, and is disposed adjacent a side of the second curved guide rail.

14. The apparatus of claim 1 further comprising an upper body supporting assembly disposed adjacent an end of the first curved guide rail, the upper body supporting assembly including a chest supporting pad.

15. The apparatus of claim 14 wherein the upper body supporting assembly includes a height adjustment mechanism to which the chest supporting pad is coupled for height adjustment of the chest supporting pad.

16. The apparatus of claim 15 wherein the height adjustment mechanism comprises a four-bar linkage.

17. The apparatus of claim 14 wherein the upper body supporting assembly further includes a pair of hand grips.

* * * * *